US007950702B1

(12) United States Patent
Adams

(10) Patent No.: US 7,950,702 B1
(45) Date of Patent: May 31, 2011

(54) RECEPTACLE FOR A GATE DROP ROD

(76) Inventor: Daniel P. Adams, Hoodsport, WA (US)

( * ) Notice: Subject to any disclaimer, the term of this patent is extended or adjusted under 35 U.S.C. 154(b) by 0 days.

(21) Appl. No.: 12/862,684

(22) Filed: Aug. 24, 2010

Related U.S. Application Data

(60) Provisional application No. 61/282,347, filed on Jan. 27, 2010.

(51) Int. Cl.
*E05C 19/00* (2006.01)
*E05B 15/02* (2006.01)

(52) U.S. Cl. . 292/1; 292/340; 292/341.14; 292/DIG. 29

(58) Field of Classification Search ..... 292/1, 57, 292/137, 340, 341.14, DIG. 29; 256/65.14; 404/25; 52/19, 298
See application file for complete search history.

(56) References Cited

U.S. PATENT DOCUMENTS

| | | | | |
|---|---|---|---|---|
| 920,305 | A * | 5/1909 | Finch | 49/381 |
| 1,355,371 | A * | 10/1920 | Patrick | 292/57 |
| 1,792,540 | A * | 2/1931 | Johnson | 292/57 |
| 1,862,672 | A | 6/1932 | Fleming | |
| 2,940,790 | A | 6/1960 | Ingalls et al. | |
| 2,953,916 | A | 9/1960 | Thomas | |
| 3,147,031 | A | 9/1964 | Olander | |
| 3,174,314 | A | 3/1965 | Johnson | |
| 3,717,963 | A * | 2/1973 | Sauriol | 52/19 |
| 4,178,024 | A | 12/1979 | Wagner | |
| 4,263,749 | A | 4/1981 | McDougle | |
| 4,790,578 | A | 12/1988 | Barrera | |
| 5,040,251 | A * | 8/1991 | Hanford | 4/496 |
| 5,365,694 | A * | 11/1994 | Macaluso | 49/49 |
| 5,398,982 | A * | 3/1995 | Watson, Jr. | 292/259 R |
| 5,716,041 | A | 2/1998 | Groves | |
| D396,795 | S | 8/1998 | Francom | |
| 6,739,093 | B1 | 5/2004 | Holbert | |
| 6,945,575 | B2 * | 9/2005 | Thompson | 292/340 |
| 7,003,919 | B2 * | 2/2006 | Riker | 52/170 |
| 7,055,807 | B2 * | 6/2006 | Pesta | 256/65.14 |
| 7,264,286 | B2 * | 9/2007 | Thompson | 292/300 |
| 7,726,902 | B1 * | 6/2010 | Bongiovanni et al. | 404/25 |
| 2006/0231817 | A1 | 10/2006 | Worth | |

FOREIGN PATENT DOCUMENTS

JP 2007-198063 8/2007

OTHER PUBLICATIONS

Website, http://www.hooverfence.com/catalog/cpage40.htm, series of centerstops for double gates, two sheets printed from the internet on Dec. 5, 2009.

* cited by examiner

*Primary Examiner* — Carlos Lugo
(74) *Attorney, Agent, or Firm* — Richard C. Litman

(57) ABSTRACT

The receptacle for a gate drop rod includes a buried plastic canister having an open bottom for drainage. The open top of the canister is covered, and at least one gate rod opening is formed through the plastic cover. Preferably two such openings are formed to provide for different drop rod diameters. A plastic receptacle pipe of appropriate diameter is installed in the appropriate opening, and the unused passage is plugged. The canister is placed on a bed of drainage stone in the bottom of the hole, the top of the canister preferably about two inches below grade. The hole is filled with gravel and stone around the canister, and the top is covered with concrete to grade. A high visibility disc is preferably installed about the top of the protruding pipe to facilitate locating the drop rod receptacle in poor light or at night.

16 Claims, 3 Drawing Sheets

RECEPTACLE FOR A GATE DROP ROD

CROSS-REFERENCE TO RELATED APPLICATION

This application claims the benefit of U.S. Provisional Patent Application Ser. No. 61/282,347, filed Jan. 27, 2010.

BACKGROUND OF THE INVENTION

1. Field of the Invention

The present invention relates generally to doors, gates, and other closures, and particularly to a receptacle for a gate drop rod that provides an in-ground receptacle for a gate drop rod that is used to secure the center of a double gate when closed.

2. Description of the Related Art

Double-hinged gates, i.e., two gate panels having opposite hinge posts and meeting at a common centerline when closed, are commonly installed across driveways and the like at many businesses, government installations, public parks and recreational areas, manufacturing plants, farms and ranches, and even some residences. Such gates will still swing through a significant arc even when closed and secured together at their common center, unless some means is provided to prevent this movement. This is generally accomplished by means of a "drop rod," i.e., a vertical rod that passes through two or more retaining hasps attached to one of the gate panels to engage a receptacle in the ground. The second gate secures to the first gate, to prevent movement of both gate panels.

Oftentimes the receptacle provided for the drop rod is no more than an afterthought, and may be formed merely by driving the end of the drop rod into the ground to a depth of an inch or so. While this may be acceptable for a short term, such a makeshift anchor point is rapidly worn away and/or filled with debris, and must be reformed. In other instances, a length of metal pipe may be driven into the ground to serve as a receptacle for the drop rod. Again, such a receptacle may work acceptably for a relatively short period of time, but a short length of pipe of relatively narrow diameter is quick to fill with debris, thereby plugging the hole. Moreover, the installation of such a blind hole, i.e., having no drainage means, tends to trap water in the receptacle. This causes the lower end of the drop rod to rust away over a period of time. If sufficient water is present to fill the hole and that water freezes, it can be a major task to chip the frozen ice away in order to install the drop rod or remove an installed drop rod.

Japanese Patent No. 2007/198,063, published Aug. 9, 2007 shows a receptacle for a drop bar formed by an inner cylinder having a male threaded portion at its lower end that threads into the internally threaded lower portion of an outer cylinder so that the inner cylinder can be removed.

None of the above inventions or patents, taken singly or in combination, shows the present invention as claimed. Thus, a receptacle for a gate drop rod solving the aforementioned problems is desired.

SUMMARY OF THE INVENTION

The receptacle for a gate drop rod is formed of a relatively large plastic canister that is buried in the ground at the site of the drop rod installation. The canister has an open center and bottom for drainage. One or more screened openings may be provided in the lower sides of the canister, if so desired. A plastic cover is secured over the top of the canister, and at least threaded opening is formed through the cover. Preferably, two such openings are formed to provide for drop rods of different diameters. A threaded plastic fitting is installed in the passage to be used, and an end of a length of plastic pipe is threaded into the fitting. Alternatively, the pipe may be threaded directly into the opening in the cover. The unused passage is plugged. In either case, the pipe extends above the cover and the canister.

The hole in the ground into which the canister is placed is lined with relatively large gravel or stones for good drainage. The larger stones are placed about halfway up the side of the canister, with smaller gravel preferably being used for the remainder of the fill. The top of the canister is preferably positioned about two inches below grade. The pipe defining the passage for the drop rod is aligned with the desired location of the rod when the gates are closed. Concrete is poured over the top of the canister to a depth sufficient to provide a level grade with the surrounding surface, with only the plastic pipe of the drop rod receptacle extending to grade at the upper surface of the concrete. Some means of preventing the concrete from adhering to the pipe is preferable (e.g., wax paper or plastic wrap, etc., surrounding the pipe) in order to allow the pipe to be removed and a replacement installed should it become necessary in the future. Preferably, a larger diameter disc of contrasting visibility to the surrounding surface is installed over the upper end of the pipe, to facilitate finding the drop rod receptacle in the dark or in conditions of poor light.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The receptacle for a gate drop rod comprises various embodiments of an in-ground receptacle for a gate drop rod as conventionally used to secure double gates and the like in the closed position. The receptacle includes sufficient drainage and interior volume to assure that it will not become filled with water or debris and thus limit the insertion of the gate drop rod therein.

Figure 1:
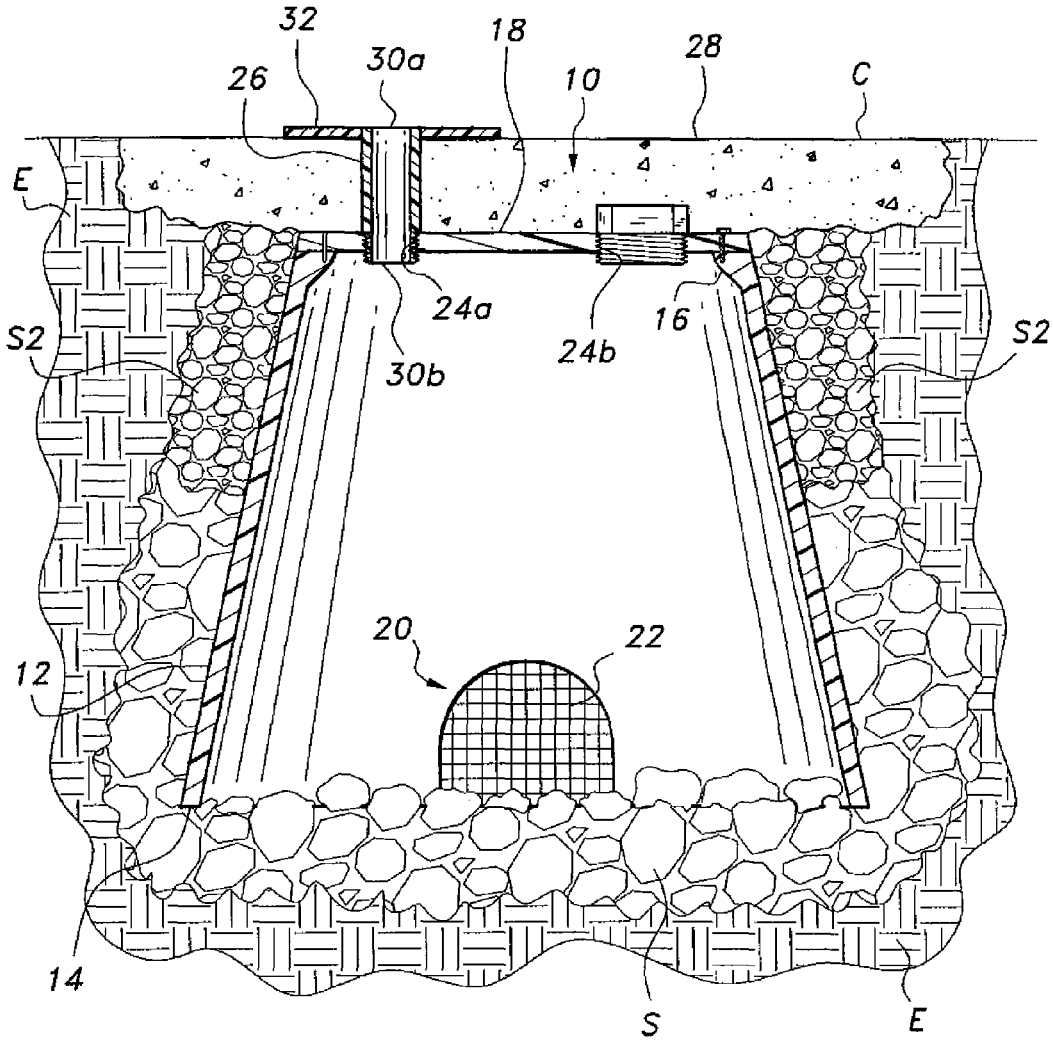
FIG. 1 is an environmental elevation view in section of a receptacle for a gate drop rod according to the present invention, illustrating its completed installation in the ground.

FIG. 1 of the drawings provides a side elevation view in section of an exemplary gate drop rod receptacle installation in the ground or earth E. The receptacle 10 includes a relatively large canister 12, as commonly used to protect underground water shutoff valves and the like. The canister 12 has an open bottom 14 to allow complete drainage therefrom, the normally open top 16 being closed by a cover 18. The canister 12 may be frustopyramidal or frustoconical in shape, providing a broad base for the diffusion and drainage of water that may enter through the drop rod passage. Only a single screw or other fastener is shown securing the cover 18 to the upper rim or top 16 of the canister 12, as all of the components of the receptacle 10 assembly will be immovably secured relative to one another once they are installed in the ground and covered.

Additional drainage may be provided adjacent to the bottom 14 of the canister 12 by a drain cutout 20, with the opening of the drain cutout 20 preferably being covered by a reasonably large mesh screen 22 to allow for drainage while preventing the entrance of gravel and/or stone S into the canister 12 during installation of the receptacle. The screen 22 may be loosely secured over the outside of the drain cutout 20, e.g., tape, etc. prior to installing the receptacle 10 in the ground, as the pressure of the surrounding stone S will hold the screen 22 in place on the canister 12 after installation of the receptacle.

Figure 3:
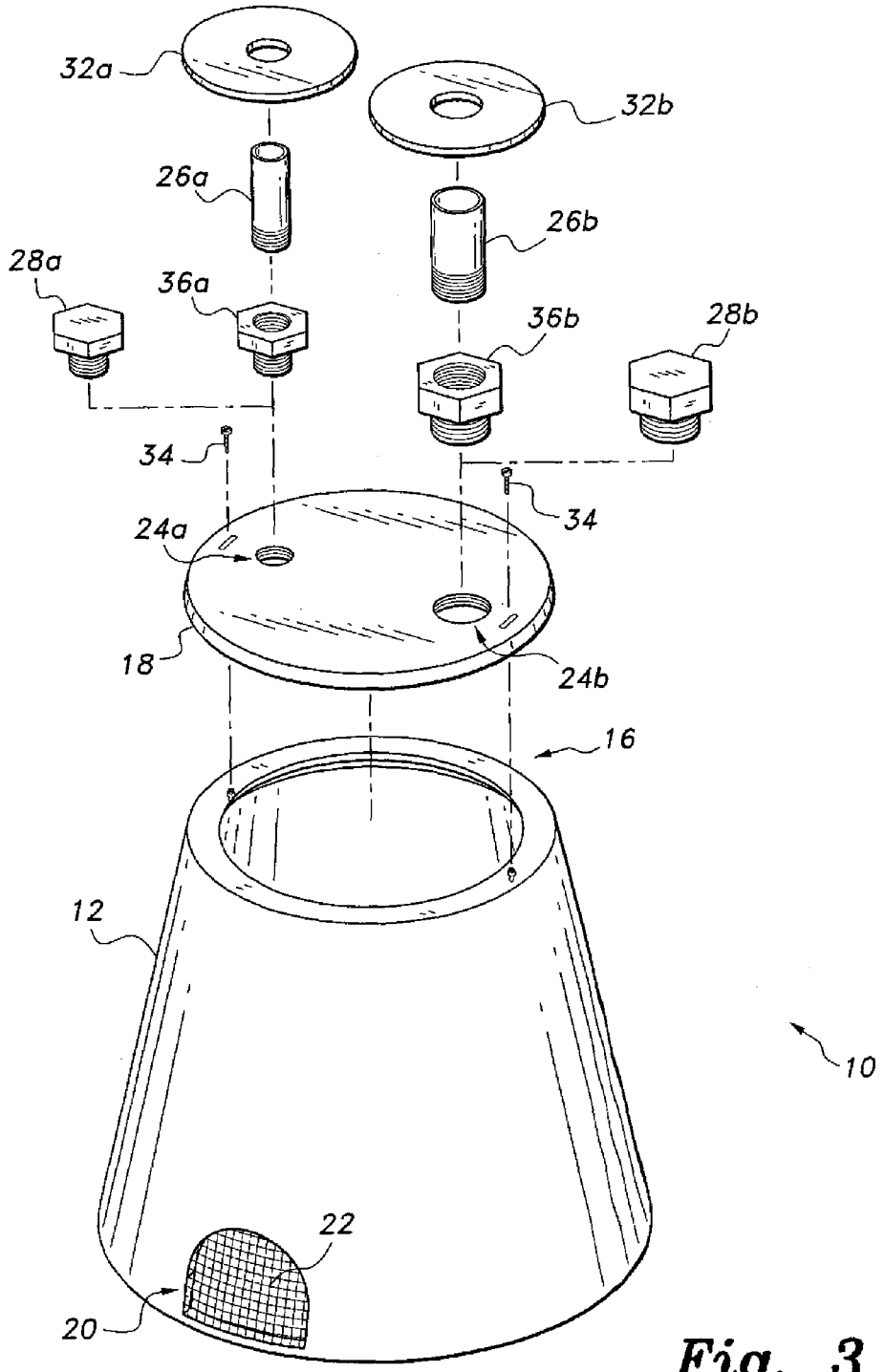
FIG. 3 is an exploded perspective view of the components comprising a kit for the receptacle for a gate drop rod according to the present invention.

The cover 18 includes at least one, and preferably two, threaded openings formed therethrough. The two openings 24*a* and 24*b* are of different diameters from one another in order to allow the installation of different diameter drop rod pipes, e.g., pipe 26, therein, depending upon the diameter of the gate drop rod with which the receptacle 10 is to be used. In the example of FIG. 1, the smaller diameter first opening 24*a* has the end of a pipe 26 of corresponding diameter installed therein, with the opposite unused larger diameter opening 24*b* being closed by a cooperating cap or plug 28. The two openings 24*a* and 24*b* are preferably internally threaded. The cooperating pipe 26 and cap or plug 28 are each provided with cooperating external threads. For this purpose, the pipe 26 has a threaded stud extending from one end that either engages one of the openings 24*a*, 24*b* directly (as shown in FIG. 1), or engages a threaded adapter (as shown in FIG. 3) installed in the opening 24*a*, 24*b*, so that the body of the pipe 26 extends above the cover 18 and the canister 12, the canister 12 serving as a pier or base to support the pipe 26. While it is envisioned that both the pipe 26 and cap 28 are permanently installed, it may be necessary to remove and replace the pipe 26 after some prolonged period of use. Accordingly, the pipe 26 may be protected from contact with the surrounding concrete C during installation to allow it to be unthreaded from its passage 24*a* and a new pipe installed as a replacement, if necessary.

The pipe 26 serves as a closely fitting sleeve for the gate drop rod, thus greatly reducing lateral play of the drop rod within the drop rod pipe 26, The pipe 26 is completely open at both its upper and lower ends 30*a* and 30*b*, to allow any moisture, debris, etc. to drop completely through the pipe 26 and into the large interior volume of the canister 12 below. Water and other moisture dissipate through the open bottom of the canister 12, and into the underlying stone and gravel S, and thence into the ground or earth E below. The open upper end 30*a* of the pipe 26 is preferably positioned just above grade, with a high visibility guide 32, e.g., a disc of contrasting color and/or high reflectivity and/or phosphorescence, etc., being secured (e.g., interference fit) about the upper end 30*a* of the pipe 26 and in contact with the underlying surface.

The drop rod receptacle 10 is installed by first digging a hole at the desired location, with the hole being somewhat larger than the dimensions of the receptacle 12. Preferably, a relatively large or coarse grade of stone S is placed in the bottom of the hole to a depth on the order of a couple of inches, more or less, as desired. The canister 12 is then placed in the hole atop the layer of stone S therein, with the cover 18 and drop rod pipe 26 in place on the canister 12. The canister 12 may be adjusted slightly, as desired, to align the pipe 26 with the drop rod of the gate by swinging the gate to the desired position and lowering the drop rod to indicate the exact position required for the receptacle 10.

Once the exact position of the receptacle 10 has been set, more stone S is placed in the hole to surround the lower portion of the canister 12. A finer grade of gravel or stone S2 is then placed about the upper portion of the canister 12, generally about up to the cover 18. Normally, the cover 18 of the canister 12 is about two inches (more or less, as desired) below grade at this point. The area atop the canister cover 18 and surrounding gravel or stone S2 is then filled with concrete C, to bring the upper surface up to grade. The upper end 30*a* of the pipe 26 may be trimmed as needed at this point, leaving only a slight amount (e.g., ¼ A inch or so) extending above the surface of the concrete C. The high visibility disc 32 is then forced over the upper end 30*a* of the drop rod pipe 26, to complete the installation.

Figure 2:
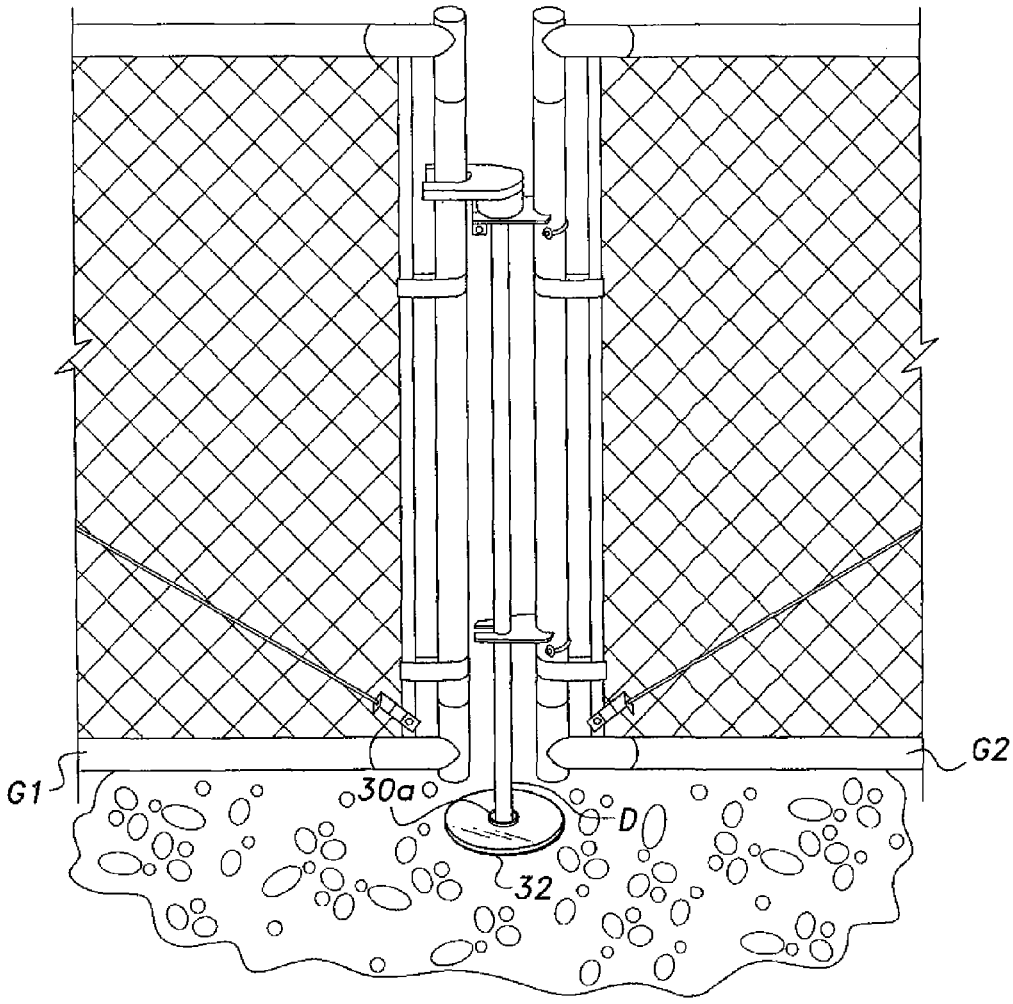
FIG. 2 is an environmental perspective view of a double gate, showing the drop rod secured by the drop rod receptacle according to the present invention.

FIG. 2 provides an illustration of an exemplary completed installation. In this above-ground view, the only portions of the receptacle that are visible, are the upper end 30*a* of the drop rod pipe and the surrounding high visibility disc 32. The two gates G1 and G2 are shown closed in this view, with the drop rod D lowered into the drop rod pipe to secure the two gates in their closed positions.

FIG. 3 of the drawings is an illustration of all of the components of a kit for assembling and installing the receptacle 10. It will be understood that not all of the components will be installed in any given installation, but various components of different diameters are provided in the kit to allow the installer to choose the desired components according to the diameter of the gate drop rod for which the receptacle 10 is to be installed.

The kit for the gate drop rod receptacle 10 includes the canister 12 with its precut lower drain cutout 20 (one or more) and installed screen 22. The cover 18 is also included, with its two previously formed and threaded drop rod passages 24*a* and 24*b*. One or more fasteners 34 may be provided for securing the cover 18 to the upper rim or top 16 of the canister 12, although the cover 18 need only be secured to the canister 12 sufficiently to prevent its being dislodged during installation of the receptacle, i.e., the pour of concrete over the cover 18. Accordingly, two drop rod pipes 26*a* and 26*b* are provided with the kit. Each of the pipes has a threaded lower end cooperating with the corresponding opening 24*a* and 24*b* of the cover 18. It should be noted that the two pipes 26*a*, 26*b* shown in FIG. 2 may be provided in somewhat longer lengths to allow the receptacle to be buried more deeply, if so desired, with the unused portion of the installed pipe 26*a* or 26*b* being cut off after installation.

Alternatively, a pair of intermediate adapters or fittings, respectively 36*a* and 36*b*, may be provided in the kit if so desired. These adapters or fittings 36*a* and 36*b* are installed in the corresponding threaded openings 24*a* and 24*b* of the cover 18, and the pipe to be used, either the smaller diameter pipe 26*a* or the larger diameter pipe 26*b*, is installed in the corresponding adapter or fitting 36*a* or 36*b*, as desired. It will be noted that when an adapter 36*a*, 36*b* is used, the openings 24*a*, 24*b* need not be threaded, but may be smooth bore openings, and the adapters 36*a*, 36*b* may be secured to the cover 18 by PVC cement or the like, the adapters being internally threaded to receive the corresponding pipe 26*a*, 26*b*. The opposite unused opening 24*a* or 24*b*, or the adapter or fitting 24*a* or 34*b* installed therein, is closed by means of a corresponding cap or plug 28*a* or 28*b*. Finally, a pair of high visibility discs 32*a* and 32*b* are provided with the kit. The only difference between the two discs 32*a*, 32*b* is the size of the central passage therein, the disc 32*a* having a smaller passage for fitting tightly about the smaller diameter drop rod pipe 26*a* and the disc 32*b* having a larger diameter passage to fit tightly about the larger diameter pipe 26*b*.

Accordingly, the receptacle 10 for a gate drop rod greatly improves the operation of a gate drop rod in securing a gate so equipped. The drainage provided by the open bottomed canister 12, and its relatively large interior volume, likely assure proper drainage of water or other liquid that may pass through the drop rod pipe 26 for years after installation. Any minor debris, e.g., leaves, pine needles, dirt, etc., that falls through the pipe 26 will be collected within the large interior volume of the canister 12, with it again being likely that this will not pose a problem for many years after installation. Preferably the various components, i.e., the canister 12, top 18, pipes 26*a* and 26*b*, caps or plugs 28*a* and 28*b*, fittings 36*a* and 36*b* (if provided with the kit), and the discs 32*a* and 32*b*, are all formed of a durable plastic material in order to prevent corrosion from the moisture accompanying the in-ground installation of the receptacle. Accordingly, the receptacle 10 for a gate drop rod in its various embodiments will likely serve well for many years, and may outlast the gates and gate installation.

It is to be understood that the present invention is not limited to the embodiments described above, but encompasses any and all embodiments within the scope of the following claims.

I claim:

1. An assembly adapted to receive a gate drop rod of a gate to secure a gate in a desired position, comprising:

an underground canister having an open bottom and an open top;

a cover disposed over the top of the canister and having pipe openings defined therethrough, each of the openings having a different diameter;

drop rod pipes, each pipe being installed within a respective pipe opening in the cover, each drop rod pipe extending above the cover and having a top open end defining guide means exposed to the outside and a bottom open end, the ends defining a drop rod passage, wherein the passages of each drop rod pipe is different from one another; and caps, each cap having a respective diameter that corresponds to a respective opening on the cover, wherein, when one of the openings receive a respective drop rod pipe, the other openings are closed by a respective cap, wherein, when the gate rod is received within the passage, the assembly will hold the gate in a desired position.

2. The assembly for a gate drop rod according to claim 1, wherein the canister has a screened drain cutout therethrough adjacent the open bottom thereof.

3. The assembly for a gate drop rod according to claim 1, wherein each of the guide means includes a high visibility guide disposed atop the drop rod pipe.

4. The assembly for a gate drop rod according to claim 1, further including an intermediate fitting disposed between the drop rod pipe opening and the drop rod pipe, thereby compensating for different sized drop rod pipes.

5. The assembly for a gate drop rod according to claim 1, wherein each of the pipe openings is internally threaded, each of the drop rod pipes being elongated, one of the ends of the pipe being externally threaded to releasably engage the internally threaded pipe opening, the pipe having a body extending above the cover and the canister, the pipe defining a drop rod passage for receiving the drop rod, the threaded end of the pipe continuing the drop rod passage through the cover.

6. An assembly adapted to receive a gate drop rod of a gate to secure a gate in a desired position, comprising:

an underground canister having an open bottom and an open top;

a cover disposed over the top of the canister and having a pipe opening of a predetermined diameter defined therethrough; and a drop rod pipe installed within the pipe opening in the cover, the drop rod pipe extending above the cover and having a top open end defining guide means exposed to the outside and a bottom open end, the ends defining a drop rod passage having the same diameter as the opening, wherein, when the gate drop rod is received within the passage, the assembly will hold the gate in a desired position.

7. The assembly for a gate drop rod according to claim 6, wherein the cover includes a second opening having a pipe opening of a predetermined second diameter defined therethrough, wherein the second diameter is different than the first diameter, the assembly further including:

a second drop rod pipe, the second drop rod pipe being sized to traverse the second diameter opening in the cover; and first and second caps for selectively installing within the drop rod passages of the cover, the first and second caps being of different diameters from one another to cooperate respectively with the first and second drop rod pipe passages of the cover thereby permitting selective closure of the opening not accommodating a drop rod pipe.

8. The assembly for a gate drop rod according to claim 6, wherein the canister has an open bottom with a screened drain cutout adjacent thereto.

9. The assembly for a gate drop rod according to claim 6, wherein each of the guide means including a high visibility guide disposed atop the drop rod pipe.

10. The assembly for a gate drop rod according to claim 6, further including an intermediate fitting disposed between the drop rod pipe opening and the drop rod pipe, thereby compensating for different sized drop rod pipes.

11. The assembly for a gate drop rod according to claim 6, wherein each of the pipe openings is internally threaded, each of the drop rod pipes being elongated, one of the ends of the pipe being externally threaded to releasably engage the internally threaded pipe opening, the pipe having a body extending above the cover and the canister, the pipe defining a drop rod passage for receiving the drop rod, the threaded end of the pipe continuing the drop rod passage through the cover.

12. An assembly kit adapted to be used with a gate to receive a gate drop rod to secure a gate in a desired position, comprising:

an underground canister having an open bottom and an open top;

a cover disposable over the top of the canister and having pipe openings defined therethrough, each of the openings having a different diameter;

drop rod pipes, each pipe being installed within a respective pipe opening in the cover, each drop rod pipe extending above the cover and having a top open end defining guide means exposed to the outside and a bottom open end, the ends defining a drop rod passage, wherein the passages of each drop rod pipe is different from one another; and caps, each cap having a respective diameter that corresponds to a respective opening on the cover, wherein, when one of the openings receive a respective drop rod pipe, the other openings are closed by a respective cap, wherein, when the gate rod is received within the passage, the assembly will hold the gate in a desired position.

13. The assembly kit for a receptacle for a gate drop rod according to claim 12, wherein the canister has an open bottom with a screened drain cutout adjacent thereto.

14. The assembly kit for a receptacle for a gate drop rod according to claim 12, wherein each of the guide means includes a high visibility guide disposed atop the drop rod pipe.

15. The assembly kit for a receptacle for a gate drop rod according to claim 12, further including first and second intermediate fittings for installing between the respective first and second drop rod openings and the first and second drop rod pipes, thereby compensating for different sized drop rod pipes.

16. The assembly kit for a receptacle for a gate drop rod according to claim 12, wherein each of the pipe openings is internally threaded, each of the drop rod pipes being elongated, one of the ends of the pipe being externally threaded to releasably engage the internally threaded pipe opening, the pipe having a body extending above the cover and the canister, the pipe defining a drop rod passage for receiving the drop rod, the threaded end of the pipe continuing the drop rod passage through the cover.

* * * * *